US006649819B1

(12) United States Patent
Boegli

(10) Patent No.: US 6,649,819 B1
(45) Date of Patent: Nov. 18, 2003

(54) INSTRUMENT SUPPORT AND PLAY APPARATUS

(76) Inventor: Ralph J. Boegli, 610 Black Oak Crescent, Waterloo, Ontario (CA), N2V 1A5

( * ) Notice: Subject to any disclaimer, the term of this patent is extended or adjusted under 35 U.S.C. 154(b) by 0 days.

(21) Appl. No.: 10/107,341

(22) Filed: Mar. 28, 2002

(51) Int. Cl.[7] ..... G10D 13/02

(52) U.S. Cl. ..... 84/421; 84/422.3; 84/327; 84/422.2

(58) Field of Search ..... 84/421, 422.1, 84/422.2, 422.3, 327

(56) References Cited

U.S. PATENT DOCUMENTS 394,078 A * 12/1888 Moxham ..... 238/267
1,808,085 A * 6/1931 Troppe ..... 84/422.1
2,581,515 A * 1/1952 Christian ..... 84/422.1
3,747,464 A * 7/1973 Russell ..... 84/422.1
4,517,876 A * 5/1985 Duhon ..... 84/422.3
4,520,710 A * 6/1985 Elliott, Jr. ..... 84/422.1
5,789,688 A * 8/1998 Schiano ..... 84/422.1
5,990,401 A * 11/1999 Braun et al. ..... 84/422.1

* cited by examiner

*Primary Examiner*—Shih-Yung Hsieh

(57) ABSTRACT

An instrument support and play apparatus for allowing the user to play more than one instrument with one's foot. The instrument support and play apparatus includes a base assembly including a base member being adapted to rest upon a surface, and also including an elongate tubular member being mounted upon and extending upwardly from the base member and being adapted to support a first cymbal upon a top thereof; and also includes an instrument support assembly being adjustably mounted to the elongate tubular member for supporting a musical instrument such as a tambourine; and further includes a first instrument striking assembly including a rod being movably disposed in the elongate tubular member and being adapted to support a second cymbal at a top end thereof; and also includes a second instrument striking assembly being supported by the base member and being adapted to support the musical instrument.

4 Claims, 5 Drawing Sheets

INSTRUMENT SUPPORT AND PLAY APPARATUS

BACKGROUND OF THE INVENTION

1. Field of the Invention

The present invention relates to apparatuses supporting and playing instruments and more particularly pertains to a new instrument support and play apparatus for allowing the user to play more than one instrument with one's foot.

2. Description of the Prior Art

The use of apparatuses supporting and playing instruments is known in the prior art. More specifically, apparatuses supporting and playing instruments heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 4,520,710; U.S. Pat. No. 2,581,515; U.S. Pat. No. 3,747,464; U.S. Pat. No. Des. 394,078; U.S. Pat. No. 5,789,688; and U.S. Pat. No. 5,990,401.

While these devices fulfill their respective, particular objectives and requirements, the aforementioned patents do not disclose a new instrument support and play apparatus. The prior art describes inventions having base members, a pedal member, and an instrument striking member for effecting sound from the instrument.

SUMMARY OF THE INVENTION

The general purpose of the present invention, which will be described subsequently in greater detail, is to provide a new instrument support and play apparatus which has many of the advantages of the apparatuses supporting and playing instruments mentioned heretofore and many novel features that result in a new instrument support and play apparatus which is not anticipated, rendered obvious, suggested, or even implied by any of the prior art apparatuses supporting and playing instruments, either alone or in any combination thereof. The present invention includes a base assembly including a base member being adapted to rest upon a surface, and also including an elongate tubular member being mounted upon and extending upwardly from the base member and being adapted to support a first cymbal upon a top thereof; and also includes an instrument support assembly being adjustably mounted to the elongate tubular member for supporting a musical instrument such as a tambourine; and further includes a first instrument striking assembly including a rod being movably disposed in the elongate tubular member and being adapted to support a second cymbal at a top end thereof; and also includes a second instrument striking assembly being supported by the base member and being adapted to support the musical instrument. None of the prior art describes inventions being capable of playing two instruments from the same apparatus.

There has thus been outlined, rather broadly, the more important features of the instrument support and play apparatus in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

It is an object of the present invention to provide a new instrument support and play apparatus which has many of the advantages of the apparatuses supporting and playing instruments mentioned heretofore and many novel features that result in a new instrument support and play apparatus which is not anticipated, rendered obvious, suggested, or even implied by any of the prior art, apparatuses supporting and playing instruments, either alone or in any combination thereof.

Still another object of the present invention is to provide a new instrument support and play apparatus for allowing the user to play more than one instrument with one's foot.

Still yet another object of the present invention is to provide a new instrument support and play apparatus that is easy and convenient to set up and use.

Even still another object of the present invention is to provide a new instrument support and play apparatus that eliminates the user having to add additional equipment or to switch equipment around to accommodate the various instruments.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings, and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
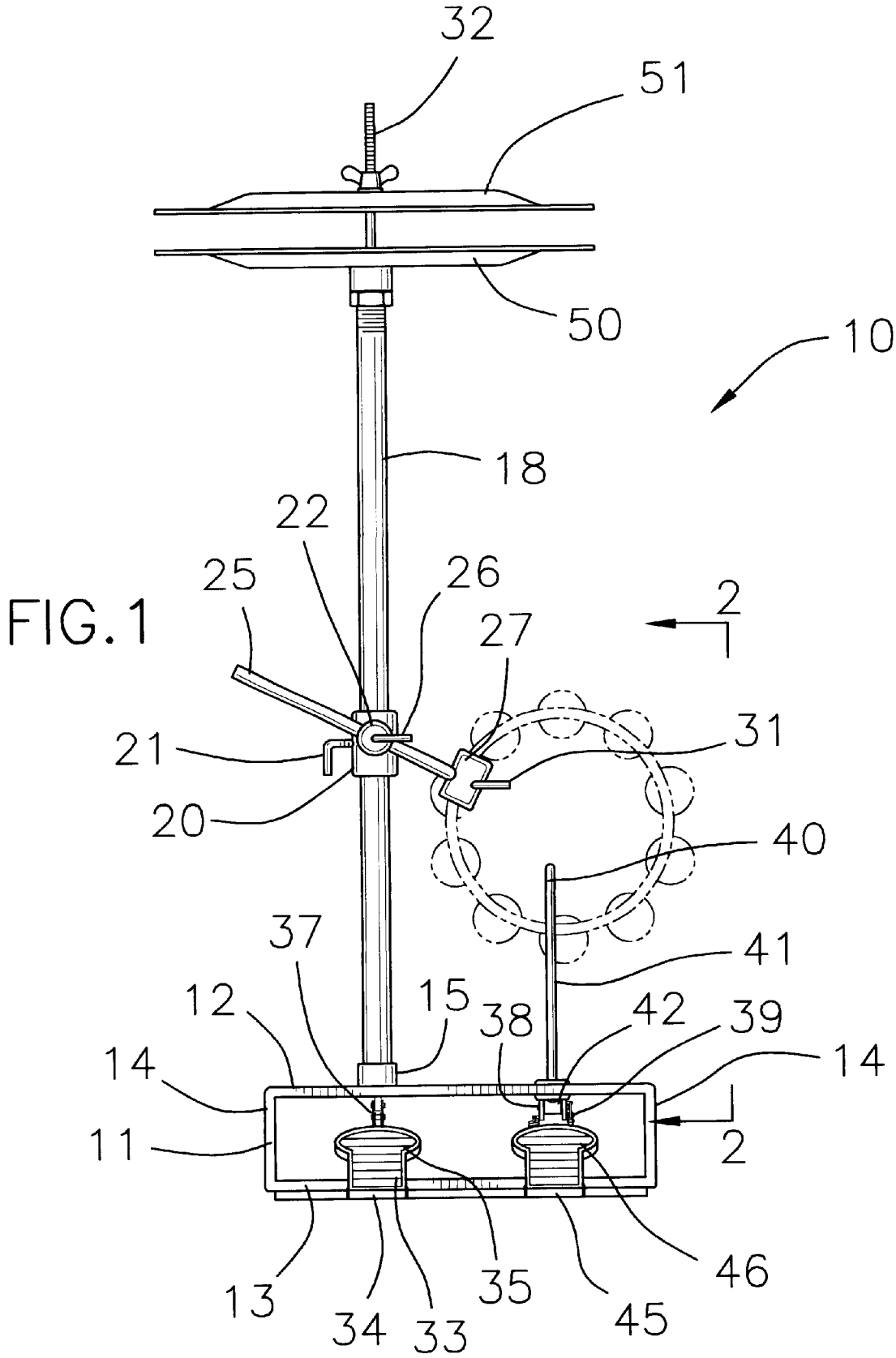
FIG. 1 is a front elevational view of a new instrument support and play apparatus according to the present invention and shown in use.
Figure 2:
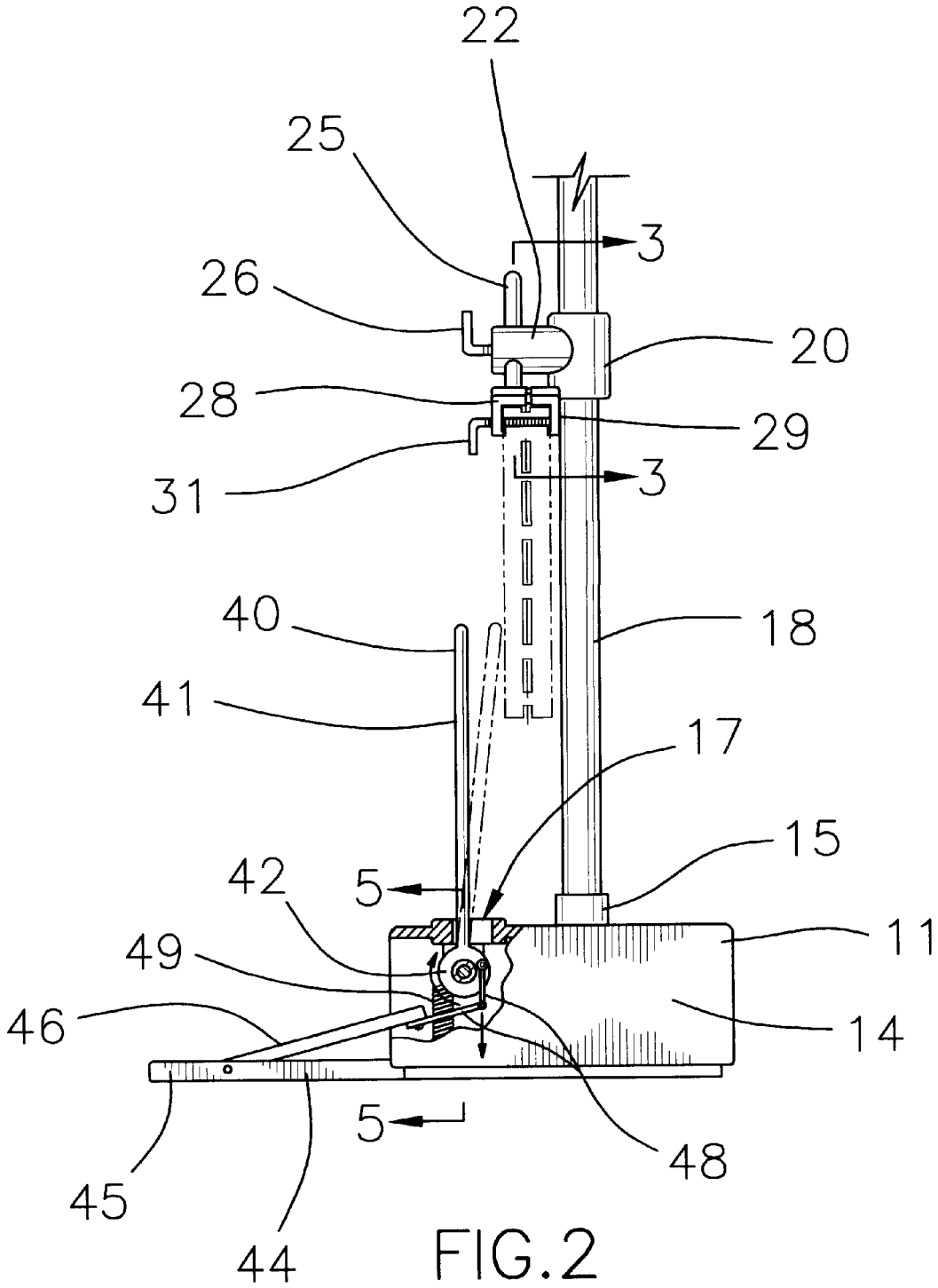
FIG. 2 is a side elevational view of the present invention.
Figure 3:
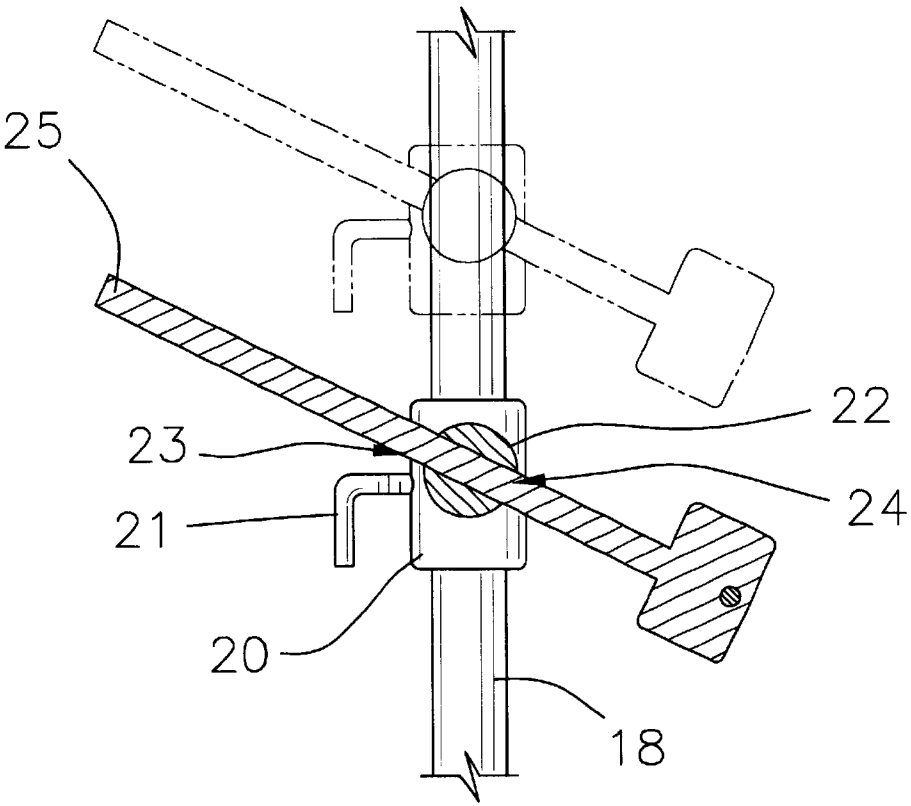
FIG. 3 is a detailed front elevational view of the boom and clamp of the present invention.
Figure 4:
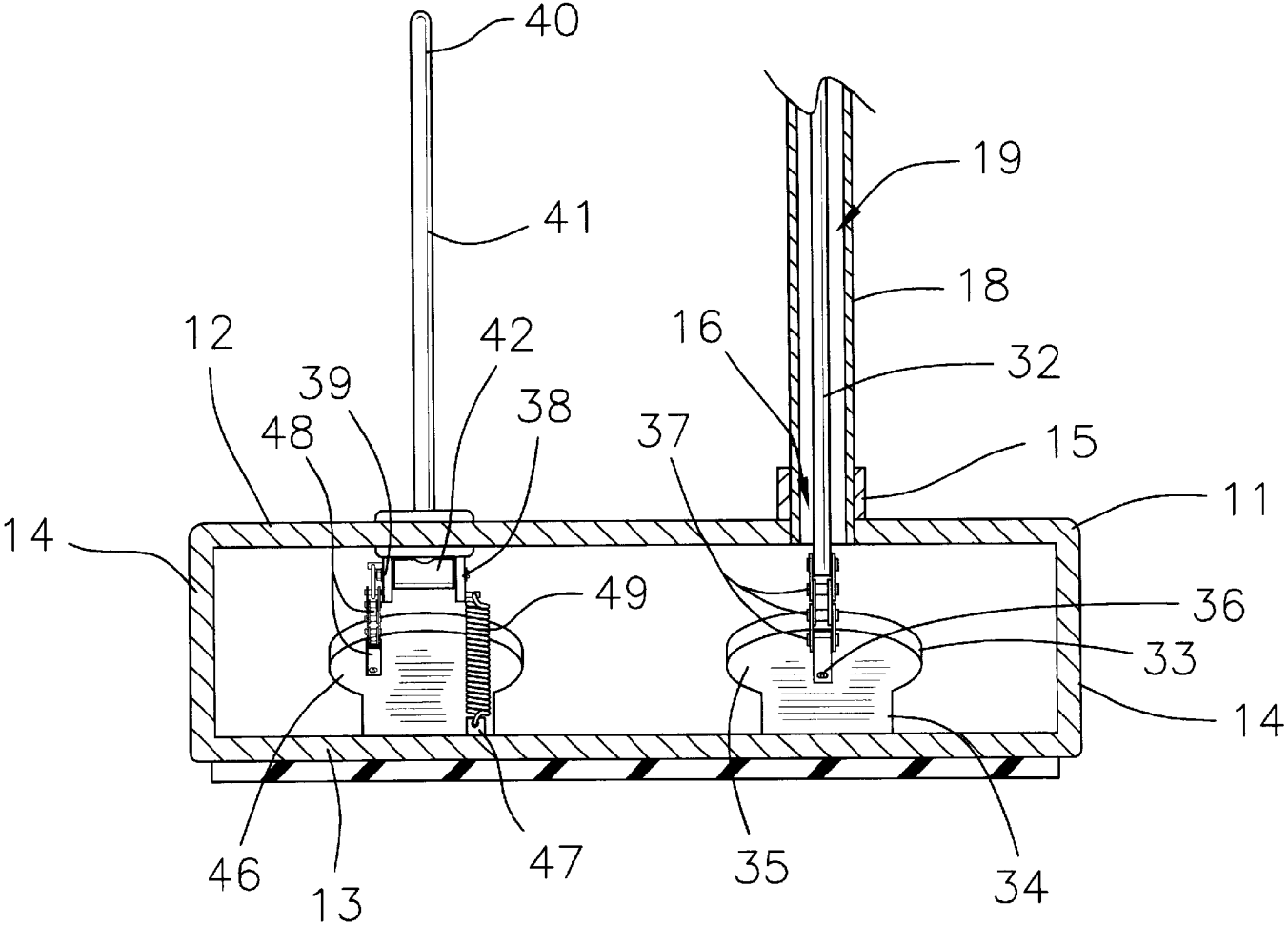
FIG. 4 is a detailed rear elevational view of the base member of the present invention.
Figure 5:
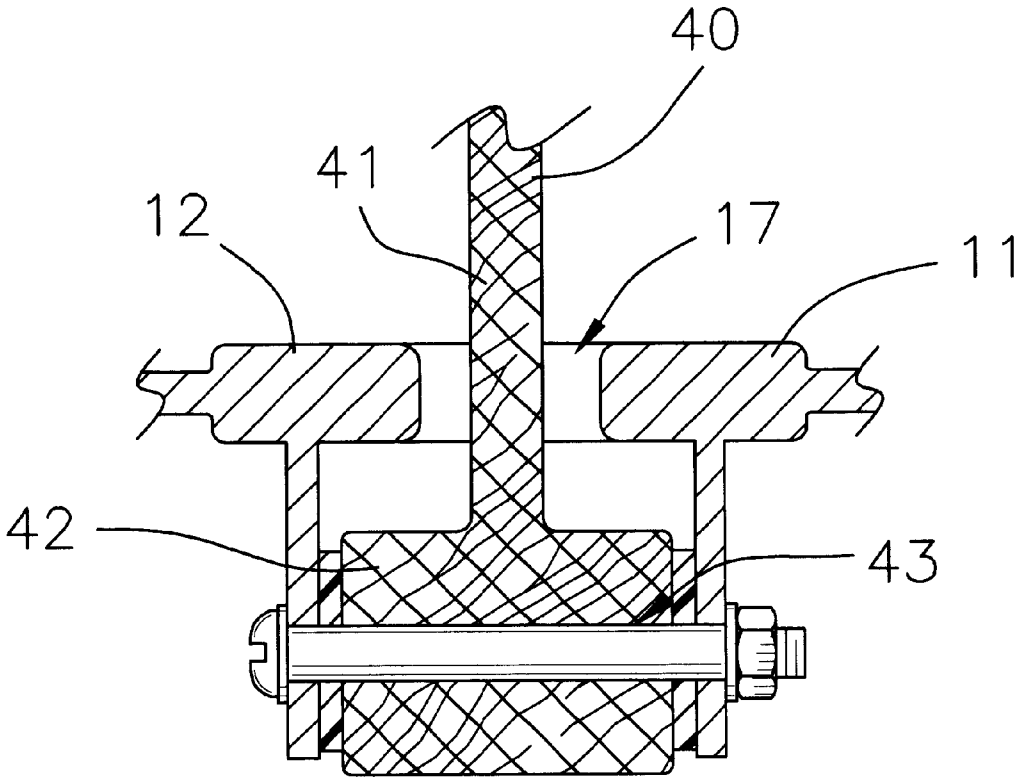
FIG. 5 is cross-sectional view of one of the instrument striking members of the present invention.

With reference now to the drawings, and in particular to FIGS. 1 through 5 thereof, a new instrument support and play apparatus embodying the principles and concepts of the present invention and generally designated by the reference numeral 10 will be described.

As best illustrated in FIGS. 1 through 5, the instrument support and play apparatus 10 generally comprises a base assembly including a base member 11 being adapted to rest upon a surface, and also including an elongate tubular member 18 being conventionally mounted upon and extending upwardly from the base member 11 and being adapted to support a first cymbal 50 upon a top thereof. The base member 11 includes top, side and bottom walls 12–14, and also includes a boss 15 being conventionally disposed upon the top wall 12 thereof, and further includes a bore 16 being disposed through the top wall 12 and through the boss 15, and also includes a hole 17 being disposed through the top wall 12. The elongate tubular member 18 is engagably disposed in the bore 16 of the boss 15, and has open ends and a bore 19 extending therethrough.

An instrument support assembly is adjustably and conventionally mounted to the elongate tubular member 18 for supporting a musical instrument such as a tambourine. The instrument support assembly includes a sleeve 20 being adjustably mounted about the elongate tubular member 18, and also includes a first fastener 21 being threaded through a wall of the sleeve 20 and being engageable to the elongate tubular member 18 for securing the sleeve 20 at a selected and preferred height, and further includes a boom support member 22 which is securely and conventionally attached to the sleeve 20 and which has a pair of opposed holes 23,24 extending through at least one wall of the boom support member 22, and also includes a boom 25 being adjustably extended through the opposed holes 23,24 of the boom support member 22, and further includes a second fastener 26 being threaded through an end wall of the boom support member 22 and being engageable to the boom 25, and also includes a clamp 27 being securely and conventionally attached to an end of the boom 25 for supporting the instrument. The clamp 27 includes a pair of opposed jaw members 28,29 with one of the jaw members 28 being securely and conventionally attached to the boom 25, and also includes a third fastener 31 being threaded through the opposed jaw members 28,29 and being adapted to engage the jaw members 28,29 about the instrument.

A first instrument striking assembly includes a rod 32 being movably disposed in the elongate tubular member 18 and being adapted to support a second cymbal 51 at a top end thereof. The first instrument striking assembly also includes a first pedal member 33 being disposed upon the bottom wall 13 of the base member 11 and having a first base support 34 and also having a first lever 35 being hingedly and conventionally mounted to the first base support 34 and being biasedly raised relative to the first base support 34. The first instrument striking assembly further includes a bracket member 36 being conventionally attached to the first lever 35, and also includes linkages 37 being conventionally attached to the bracket member 36 and being conventionally attached to a bottom end of the rod 32 for the first lever 35 to move the rod 32 downwardly so that the second cymbal 51 impacts the first cymbal 50 to effect a sound.

A second instrument striking assembly is conventionally supported by the base member 11 and is adapted to support the musical instrument. The second instrument striking assembly includes brackets 38,39 being securely and conventionally attached to an underside of the top wall 12 of the base member 11 and being disposed about the hole 17 being disposed through the top wall 12, and also includes a stick 40 being pivotally and conventionally mounted to the brackets 38,39 and extending through the hole 17 through the top wall 12 and being adapted to impact the instrument being supported by the instrument support assembly, and further includes a second pedal member 44 having a second base support 45 and also having a second lever 46 being hingedly and conventionally attached to the second base support 45 for pivoting the stick 40 to strike the instrument, and also includes linkage members 48 being conventionally connected to the second lever 46 and to the stick 40, and further includes a spring 49 having ends being conventionally attached to the stick 40 and to an eyelet 47 being conventionally mounted upon the bottom wall 13 of the base member 11 for pivotally moving the stick 40 out of contact with the instrument. The stick 40 includes an elongate main portion 41, and also includes a cylindrical-shaped end portion 42 which has a bore 43 extending therethrough and which is pivotally mounted with a fastening member to the brackets 38,39 with the bore 43 of the cylindrical-shaped end portion 42 having a longitudinal axis which is disposed generally perpendicular to the elongate main portion 41 of the stick 40.

In use, the user presses down on the particular first or second lever 35,46 to effect the striking of either the first and second cymbals 50,51 together or the instrument such as the tambourine. Upon the user pressing down on the first lever 35, the rod 32 is moved downwardly with the second cymbal 51 being brought into contact with the first cymbal 50. Upon the user pressing down on the second lever 46, the stick 40 is pivoted and is impacted upon the instrument to effect a sound.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the instrument support and play apparatus. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. An instrument support and play apparatus comprising:

a base assembly including a base member being adapted to rest upon a surface, and also including an elongate tubular member being mounted upon and extending upwardly from said base member and being adapted to support a first cymbal upon a top thereof;

an instrument support assembly being adjustably mounted to said elongate tubular member for supporting a musical instrument, said instrument support assembly including a sleeve being adjustably mounted about said elongate tubular member, and also including a first fastener being threaded through a wall of said sleeve and being engageable to said elongate tubular member, and further including a boom support member which is securely attached to said sleeve and which has a pair of opposed holes extending through at least one wall of said boom support member, and also including a boom being adjustably extended through said opposed holes of said boom support member, and further including a second fastener being threaded through an end wall of said boom support member and being engageable to said boom, and also including a clamp being securely attached to an end of said boom for supporting the instrument;

a first instrument striking assembly including a rod being movably disposed in said elongate tubular member and being adapted to support a second cymbal at a top end thereof; and a second instrument striking assembly being supported by said base member and being adapted to support the musical instrument.

2. An instrument support and play apparatus as described in claim 1, wherein said clamp includes a pair of opposed jaw members with one of said jaw members being securely and conventionally attached to said boom, and also includes a third fastener being threaded through the opposed jaw members and being adapted to engage the jaw members about the instrument.

3. An instrument support and play apparatus comprising;

a base assembly including a base member being adapted to rest upon a surface, and also including an elongate tubular member being mounted upon and extending upwardly from said base member and being adapted to support a first cymbal upon a top thereof, said base member including top, side and bottom walls, and also including a boss being disposed upon said top wall thereof, and further including a bore being disposed through said top wall and through said boss, and also including a hole being disposed through said top wall;

an instrument support assembly being adjustable mounted to said elongate tubular member for supporting a musical instrument;

a first instrument striking assembly including a rod being movably disposed in said elongate tubular member and being adapted to support a second cymbal at a top end thereof; and a second instrument striking assembly being supported by said base member and being adapted to support the musical instrument, said second instrument striking assembly including brackets being securely attached to an underside of said top wall of said base member and being disposed about said hole being disposed through said top wall, and also including a stick being pivotally mounted to said brackets and extending through said hole through said top wall and being adapted to impact the instrument being supported by said instrument support assembly, and further including a second pedal member having a second base support and also having a second lever being hingedly attached to said base support for pivoting said stick to strike the instrument, and also including linkage members being connected to said second lever and to said stick, and further including a spring having ends attached to said stick and to an eyelet being mounted upon said bottom wall of said base member for pivotally moving said stick out of contact with the instrument.

4. An instrument support and play apparatus as described in claim 3, wherein said stick includes an elongate main portion, and also includes a cylindrical-shaped end portion which has a bore extending therethrough and which is pivotally mounted with a fastening member to said brackets, said bore of said cylindrical-shaped end portion having a longitudinal axis which is disposed generally perpendicular to said elongate main portion of said stick.

* * * * *